US010975505B2

(12) United States Patent
Ruggles

(10) Patent No.: US 10,975,505 B2
(45) Date of Patent: Apr. 13, 2021

(54) FABRIC SUSPENSION FRAME POLE RATCHET MECHANISM

(71) Applicant: HANDI QUILTER, INC., North Salt Lake, UT (US)

(72) Inventor: Bryan K. Ruggles, Riverton, UT (US)

(73) Assignee: HANDI QUILTER, INC., North Salt Lake, UT (US)

( * ) Notice: Subject to any disclaimer, the term of this patent is extended or adjusted under 35 U.S.C. 154(b) by 465 days.

(21) Appl. No.: 16/141,744

(22) Filed: Sep. 25, 2018

(65) Prior Publication Data

US 2020/0095715 A1 Mar. 26, 2020

(51) Int. Cl.
*D05B 39/00* (2006.01)

(52) U.S. Cl.
CPC ..... *D05B 39/005* (2013.01)

(58) Field of Classification Search
CPC ..... D05B 39/005; D05B 11/00; D05C 1/02; D05C 9/04
USPC ..... 112/103, 119; 38/102.21, 102.91; 166/378
See application file for complete search history.

(56) References Cited

U.S. PATENT DOCUMENTS 5,913,275 A * 6/1999 Flynn ..... D05C 1/02 112/119
6,631,688 B1 * 10/2003 Maag ..... D05B 11/00 112/118
6,757,996 B1 * 7/2004 Bellavich ..... D05B 39/005 38/102.21
7,011,031 B1 * 3/2006 Bradley ..... D05B 11/00 112/119
2003/0079666 A1 * 5/2003 Barrus ..... D05B 11/00 112/117

FOREIGN PATENT DOCUMENTS

GB 172598 A * 5/1922 ..... D05C 1/02

* cited by examiner

*Primary Examiner* — Nathan E Durham
(74) *Attorney, Agent, or Firm* — Maschoff Brennan

(57) ABSTRACT

Fabric suspension frame pole ratchet mechanism. In some embodiments, an example fabric suspension frame may include a pole support side arm, a pole configured to have fabric spooled thereon, and a pole ratchet mechanism. The pole may be configured to be manually rotated in a first rotational direction and a second opposite rotational direction. The pole ratchet mechanism may include a ratchet sleeve attached to the pole, a ratchet slider configured to be positioned in a receiving slot of the pole support side arm, and a ratchet shifter attached to the pole. The ratchet sleeve may define a first set of teeth, and the ratchet slider may define a second set of teeth configured to selectively engage with the first set of teeth. The ratchet shifter may be configured to be manually shifted between an engaged position and a disengaged position.

20 Claims, 13 Drawing Sheets

FABRIC SUSPENSION FRAME POLE RATCHET MECHANISM

BACKGROUND

Sewing machines generally function by reciprocating a threaded needle into and out of one or more layers of fabric to form a row of stitches in the fabric. While some sewing machines are operated in a stationary fashion while the fabric is repositioned underneath the needle, other sewing machines, such as quilting machines, are operated in a maneuverable fashion by repositioning the needle while the fabric remains stationary. When operated in this maneuverable fashion, the fabric typically remains stationary and mounted on a frame, known as a quilting frame or fabric suspension frame.

A fabric suspension frame used for quilting generally includes one or more poles upon which layers of fabric are spooled. In particular, a first pole may be spooled with an upper quilt-top fabric, a second pole may be spooled with a lower quilt-backing fabric, a third pole may be spooled with a middle quilt-batting fabric, and a fourth pole may be spooled with a composite sandwich of the three layers of fabric quilted together as the finished quilt. At least one of the poles may include a mechanism for applying tension to the layers of fabric in order to provide a generally flat sewing surface for the quilting process undertaken using the quilting machine.

Typical pole tensioning mechanisms often include a ratchet wheel and pawl system. However, one problem encountered with current pole tensioning mechanisms is difficulty encountered when engaging and disengaging the ratchet wheel and pawl systems. For example, friction in a typical ratchet wheel and pawl system may create pressure that can be hard to overcome, and there exists the possibility that a user's fingers may become pinched. Another problem encountered with current pole tensioning mechanisms is the cost and complexity associated with portions of the pole tensioning mechanism that are separate from the pole itself and are instead integrated into other portions of the fabric suspension frame.

The subject matter claimed herein is not limited to embodiments that solve any disadvantages or that operate only in environments such as those described above. Rather, this background is only provided to illustrate one example technology area where some embodiments described herein may be practiced.

SUMMARY

In some embodiments, an example fabric suspension frame may include a pole support side arm defining a receiving slot, a pole configured to have fabric spooled thereon, and a pole ratchet mechanism. The pole may be configured to be manually rotated in a first rotational direction and a second rotational direction that is opposite from the first rotational direction. The pole ratchet mechanism may include a ratchet sleeve attached to the pole, a ratchet slider configured to be positioned in the receiving slot of the pole support side arm, and a ratchet shifter attached to the pole. The ratchet sleeve may define a first set of teeth, and the ratchet slider may define a second set of teeth configured to selectively engage with the first set of teeth. The ratchet shifter may be configured to be manually shifted between an engaged position and a disengaged position. The engaged position may include the first set of teeth engaging with the second set of teeth to allow the pole to be manually rotated only in the first rotational direction. The disengaged position may include the first set of teeth disengaged from the second set of teeth to allow the pole to be manually rotated both in the first rotational direction and in the second rotational direction.

In some embodiments, each tooth of the first set of teeth and the second set of teeth may have a vertical edge and a sloped edge, such that engagement of the first set of teeth and the second set of teeth allows the sloped edges to slide past each other in the first rotational direction but prevents the vertical edges from sliding past each other in the second rotational direction.

In some embodiments, the ratchet shifter may extend at least partially into the pole. In these embodiments, the ratchet shifter may extend all the way through the pole, and the ratchet shifter may include a shifter magnet positioned within the ratchet shifter. In these embodiments, the ratchet shifter may be configured to be manually shifted between the engaged position and the disengaged position by sliding the ratchet shifter at least partially through the pole. In these embodiments, a first portion of the ratchet shifter extending from the pole may be visually different from a second portion of the ratchet shifter extending from the pole opposite the first portion. In these embodiments, the first portion of the ratchet shifter may include a head that is visually different from the second portion of the ratchet shifter.

In some embodiments, the pole ratchet mechanism may further include an engagement spring. In these embodiments, the engaged position may allow the engagement spring to bias the first set of teeth to engage with the second set of teeth to allow the pole to be manually rotated only in the first rotational direction. Also, in these embodiments, the disengaged position may overcome the bias of the engagement spring to force the first set of teeth to disengage from the second set of teeth to allow the pole to be manually rotated both in the first rotational direction and in the second rotational direction. In these embodiments, the engagement spring may be positioned within the pole. In these embodiments, the engagement spring may be positioned within the ratchet sleeve.

In some embodiments, the pole ratchet mechanism may further include a ratchet core including a ratchet core shaft, a handle attached to the ratchet core shaft, and an engagement spring surrounding the ratchet core shaft. In these embodiments, the ratchet core shaft may be slidably attached to the ratchet sleeve to allow the ratchet core shaft to slide laterally with respect to the ratchet sleeve but to prevent the ratchet core shaft from rotating without the ratchet sleeve also rotating. In these embodiments, the handle may be configured to be manually rotated in order to rotate the ratchet core shaft, the ratchet sleeve, and the pole. In these embodiments, the engagement spring may be positioned within the ratchet sleeve and within the pole and the engagement spring may bias the ratchet core shaft into the pole. In these embodiments, the pole ratchet mechanism may further include a hand wheel by which the handle is attached to the ratchet core shaft, with the hand wheel being configured to be manually rotated in order to rotate the ratchet core shaft, the ratchet sleeve, and the pole.

In some embodiments, the pole support side arm may define two additional receiving slots, and the fabric suspension frame may further include two other of the poles and two other of the ratchet mechanisms. In some embodiments, the pole support side arm may include a pole cradle attached thereto that is configured to support the weight of the pole.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DESCRIPTION OF EMBODIMENTS

A quilting machine is generally operated in a maneuverable fashion by repositioning the needle while the fabric remains stationary and mounted on a fabric suspension frame, which generally includes one or more poles upon which layers of fabric are spooled. At least one of the poles may include a mechanism for applying tension to the layers of fabric in order to provide a generally flat sewing surface for the quilting process undertaken using the quilting machine. Unfortunately, however, current pole tensioning mechanisms having a ratchet wheel and pawl system may be difficult to operate, as it can be a challenge to disengage or separate the pawl from the ratchet wheel while the fabric is under tension, and the open nature of the ratchet wheel and pawl system may contribute to pinching a user's fingers. Further, current pole tensioning mechanisms include relatively complex and costly portions that are separate from the pole itself and are instead integrated into other portions of the fabric suspension frame.

The embodiments disclosed herein may provide various benefits. In particular, the embodiments disclosed herein may, for example, provide a fabric suspension frame pole ratchet mechanism that is generally integrated into the pole instead of including portions that are separate from the pole. As such, the embodiments of the fabric suspension frame pole ratchet mechanism disclosed herein may be easier and more ergonomic to use while being simpler and less costly than current pole tensioning mechanisms, and may also include less risk for a user's fingers to be pinched than current pole tensioning mechanisms.

Figure 1A:
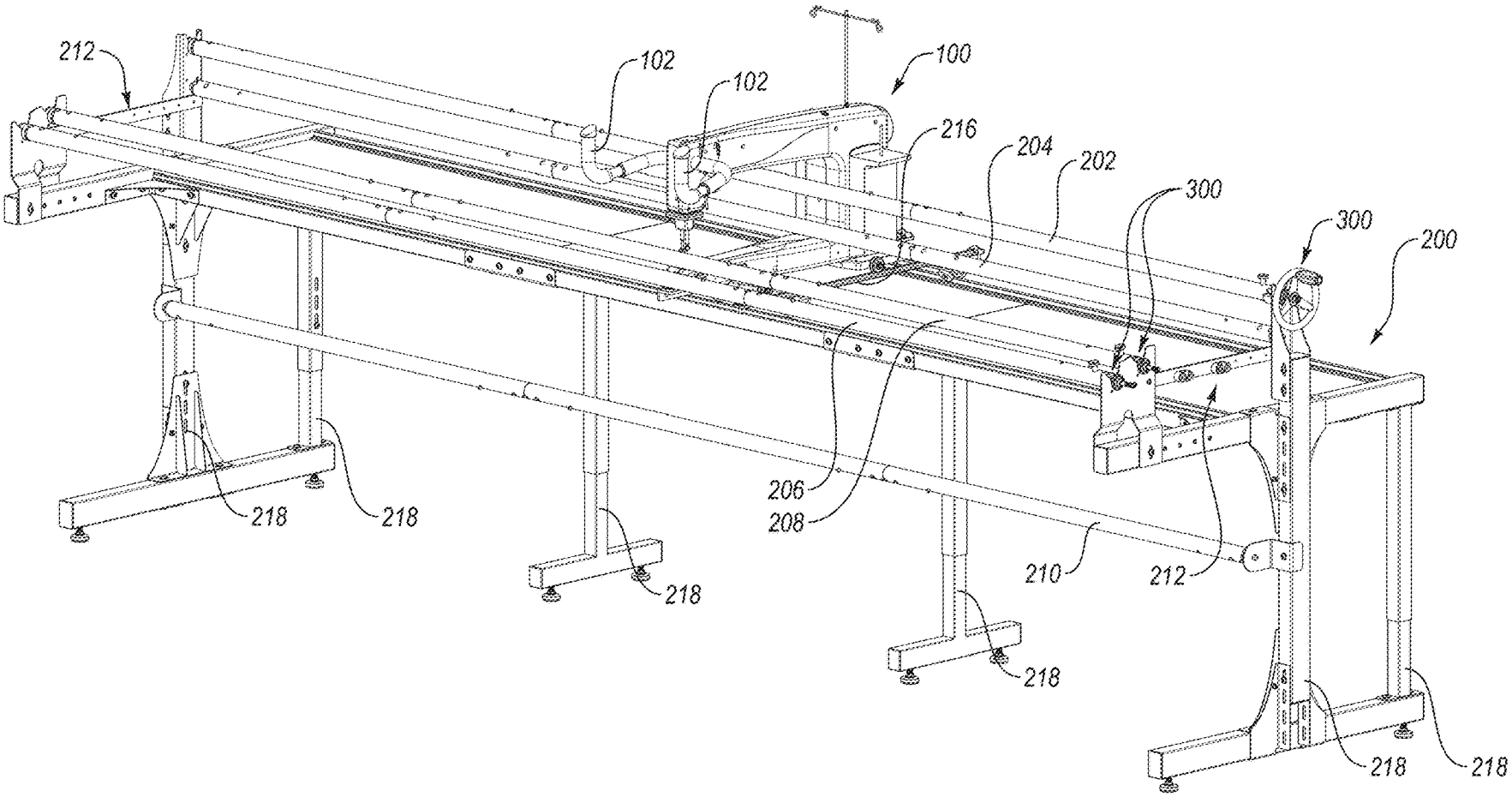
FIG. 1A is a front top perspective view of an example quilting machine mounted on an example fabric suspension frame.
Figure 1B:
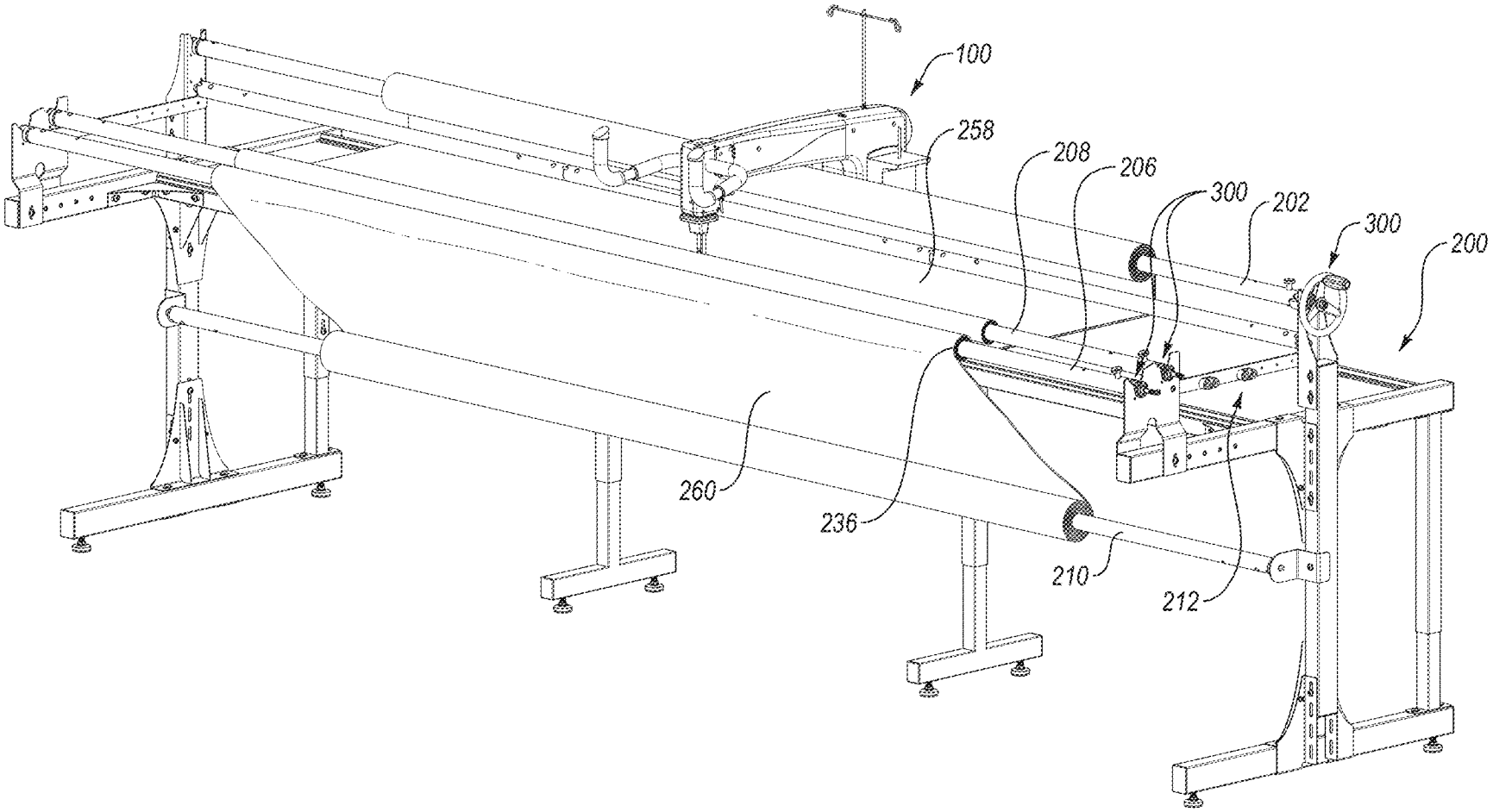
FIG. 1B is a front top perspective view of the example quilting machine mounted on the example fabric suspension frame of FIG. 1A with fabric spooled thereon.

Turning to the figures, FIG. 1A is a front top perspective view of an example maneuverable quilting machine 100 mounted on an example fabric suspension frame 200, and FIG. 1B is a front top perspective view of the example maneuverable quilting machine 100 mounted on the example fabric suspension frame 200 of FIG. 1A with fabric spooled thereon.

The maneuverable quilting machine 100 of FIGS. 1A-1B is specialized for quilting and is known as a long-arm quilting machine. A long-arm quilting machine may be distinguished from other types of sewing machines because of the "long-arm" configuration of the machine. A long-arm quilting machine may include one or more of handlebars 102 and a needle (not shown due to being hidden by pole 208), among other components. Quilting using the maneuverable quilting machine 100 typically involves stitching together multiple layers of fabric to form a quilt. A quilt typically includes a layer of quilt-batting fabric sandwiched in between an upper quilt-top fabric and a lower quilt-backing fabric. However, although the example maneuverable quilting machine 100 of FIGS. 1A-1B is a long-arm quilting machine, it is understood that the maneuverable quilting machine 100 is only one of countless maneuverable sewing or quilting machines in which the example fabric suspension frame pole ratchet mechanism disclosed herein may be employed. The scope of the example fabric suspension frame pole ratchet mechanism disclosed herein is therefore not intended to be limited to employment with any particular quilting machine.

As disclosed in FIG. 1A, the fabric suspension frame 200 may include a take-up pole 202, an idler pole 204, a quilt-backing pole 206, a quilt-top pole 208, a quilt-batting pole 210, and pole support side arms 212 at distal ends of the fabric poles. The fabric suspension frame 200 may further include a tabletop 214 upon which a carriage 216 is mounted, as well as legs 218 supporting the pole support side arms 212 and the tabletop 214. It is understood that the fabric suspension frame 200 is only one of countless fabric suspension frames with which the example fabric suspension frame pole ratchet mechanism disclosed herein may be employed. The scope of the example fabric suspension frame pole ratchet mechanism disclosed herein is therefore not intended to be limited to employment with any particular fabric suspension frame.

Each of the quilt-backing pole 206, the quilt-top pole 208, and the quilt-batting pole 210 may be configured to have a layer of fabric spooled thereon, and the maneuverable quilting machine 100 may be employed to sew these three layers of fabric together into a quilt that is then spooled on the take-up pole 202. For example, as disclosed in FIG. 1B, the quilt-backing pole 206 may be configured to have quilt-backing fabric 256 spooled thereon such that the quilt-backing fabric 256 flows from the front of the quilt-backing pole 206, under the bottom of the quilt-backing pole 206, under the needle (not shown) of the maneuverable quilting machine 100, and under the bottom of the idler pole 204. At the same time, the quilt-top pole 208 may be configured to have quilt-top fabric 258 spooled thereon such that the quilt-top fabric 258 flows from the front of the quilt-top pole 208, under the bottom of the quilt-top pole 208, under the needle (not shown) of the maneuverable quilting machine 100, and under the bottom of the idler pole 204. Also at the same time, the quilt-batting pole 210 may be configured to have quilt-batting fabric 260 spooled thereon such that the quilt-batting fabric 260 flows from the quilt-batting pole 210, over the top of the quilt-backing pole 206 and under the quilt-top pole 208 to flow between the quilt-top pole 208 and the quilt-backing pole 206 (e.g., to be sandwiched between the quilt-top fabric 258 and the quilt-backing fabric 256), under the needle (not shown) of the maneuverable quilting machine 100, and under the bottom of the idler pole 204. Then, all three layers of fabric (the quilt-backing fabric 256, the quilt-top fabric 258, and the quilt-batting fabric 260) may be spooled onto the take-up pole 202.

In some embodiments, the quilt-backing pole 206, the quilt-top pole 208, and the take-up pole 202 may include pole ratchet mechanisms 300 configured to apply tension to the fabric spooled on the poles. Although only the take-up pole 202 is pictured in FIGS. 1A and 1B as including a hand wheel and a handle included in the pole ratchet mechanism 300, it is understood that the quilt-backing pole 206 and the quilt-top pole 208 may also include similar hand wheels and handles. It is further understood that other poles of the fabric suspension frame 200 may also include similar pole ratchet mechanisms.

In some embodiments, the take-up pole 202 may include a pole ratchet mechanism 300 configured to apply tension to the fabric spooled on the pole. Although only the take-up pole 202 is pictured in FIGS. 1A and 1B as including a pole ratchet mechanism 300, it is understood that other poles of the fabric suspension frame 200 may also include similar pole ratchet mechanisms, such as the quilt-backing pole 206 and the quilt-top pole 208.

In some embodiments, the bottom of the quilt-top pole 208 and the bottom of the idler pole 204 may form a plane in which the maneuverable quilting machine 100 is configured to sew. In order to set and maintain a desired amount of tension to the quilt-backing fabric 256 and the quilt-top fabric 258 (and the quilt-batting fabric 260 sandwiched there between), the pole ratchet mechanisms 300 may be employed. In particular, the pole ratchet mechanisms 300 of the quilt-top pole 208, the quilt-backing pole 206, and take-up pole 202 may be employed to allow a user to manually rotate these poles until the quilt-backing fabric 256 and the quilt-top fabric 258 has a desired amount of tension just beneath the plane between the bottom of the quilt-top pole 208 and the bottom of the idler pole 204. Once this desired amount of tension is set by the user, the pole ratchet mechanisms 300 may be employed to maintain this desired amount of tension.

Figure 2:
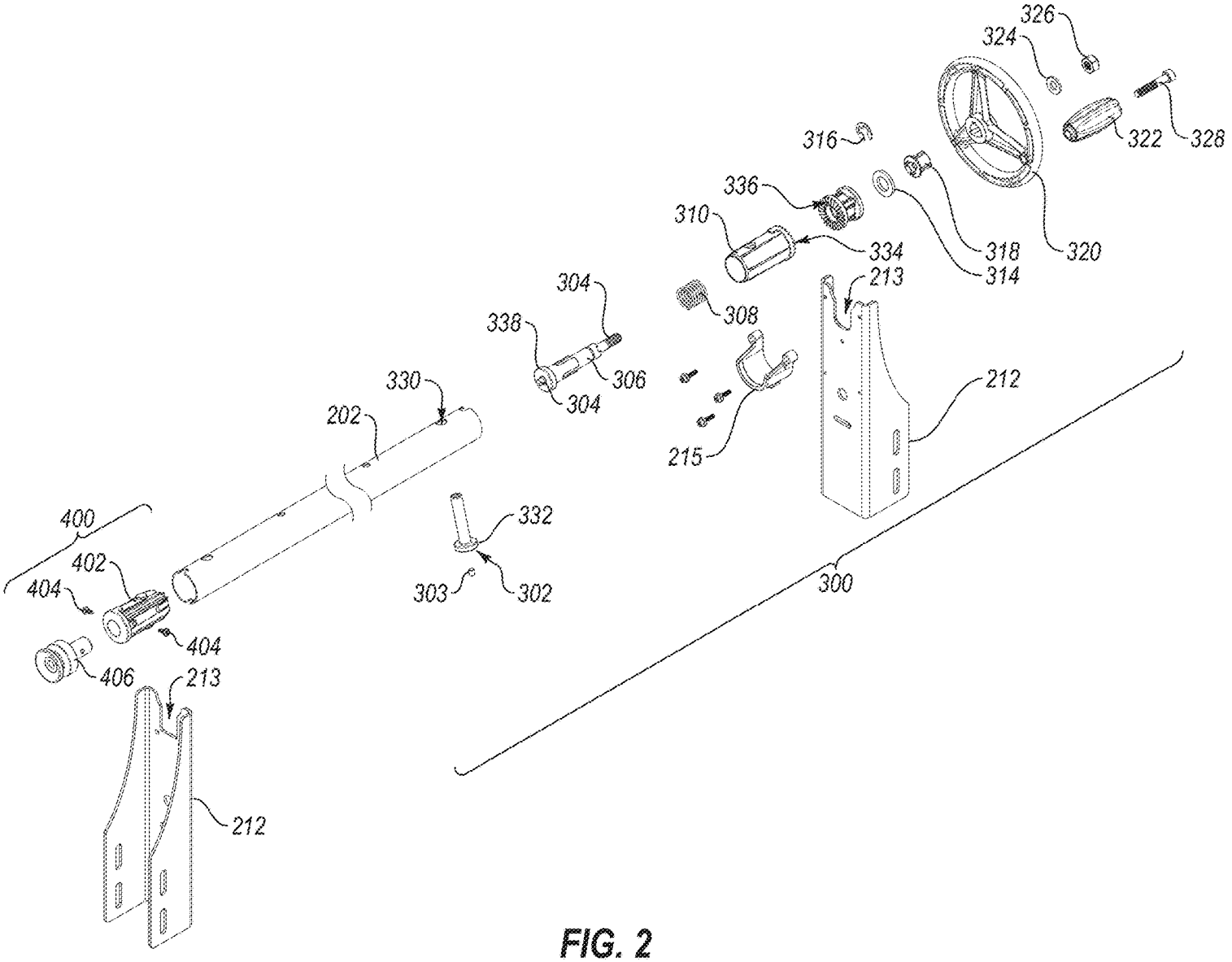
FIG. 2 is an exploded perspective view of a portion of a pole support side arm, a pole, and a pole ratchet mechanism of the fabric suspension frame of FIGS. 1A and 1B.

FIG. 2 is an exploded perspective view of a portion of the pole support side arm 212, the pole 202, and the pole ratchet mechanism 300 of the fabric suspension frame 200 of FIGS. 1A and 1B. As disclosed in FIG. 2, the pole ratchet mechanism 300 may include a ratchet shifter 302, a ratchet core 306 including a ratchet core shaft 304 (and optionally surrounded by a ratchet core housing), an engagement spring 308, a ratchet sleeve 310, a ratchet slider 312, a washer 314, an e-clip 316, a collar 318, a hand wheel 320, a handle 322, a washer 324, a nut 326, and a handle bolt 328.

Figure 3A:
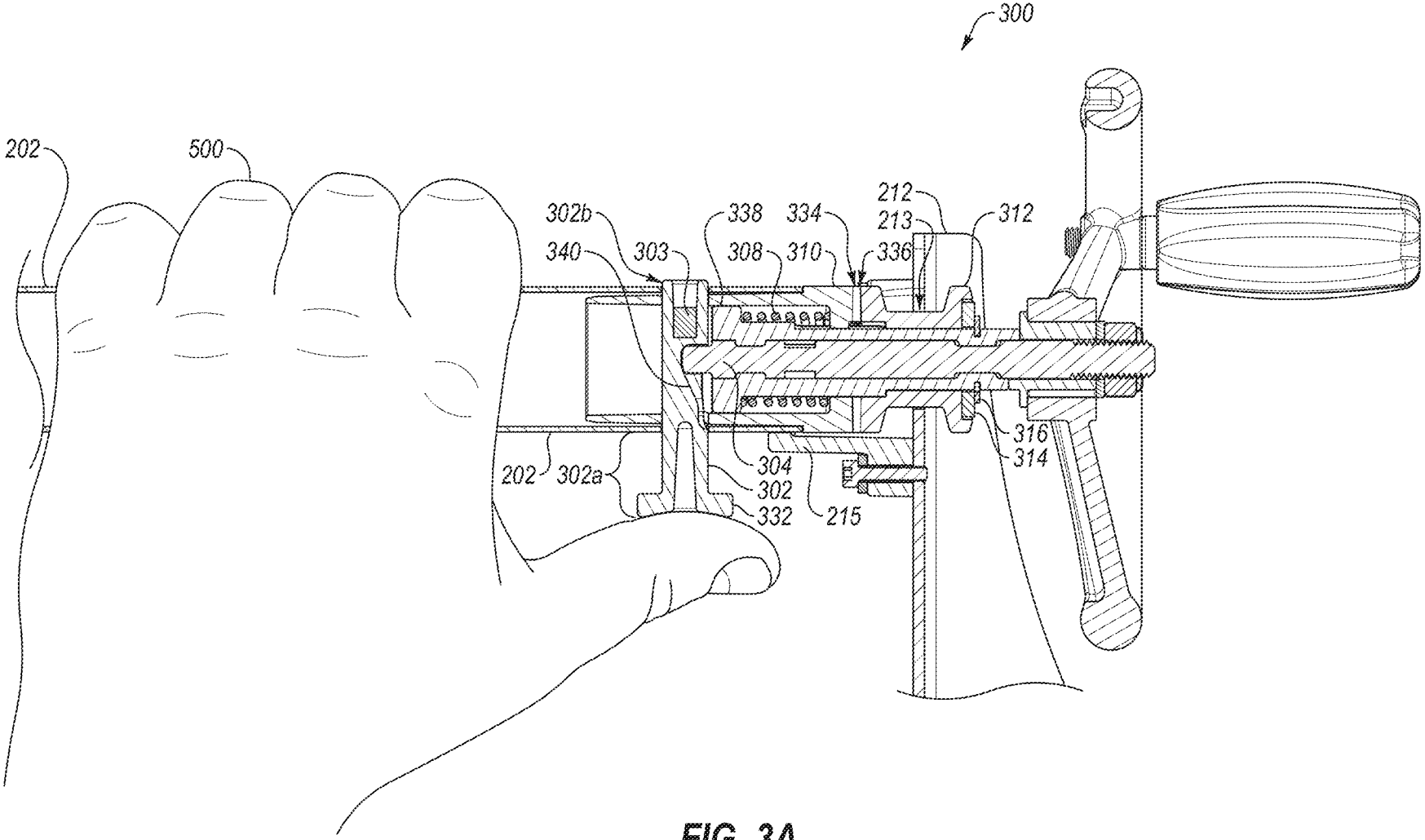
FIGS. 3A-3F are partial-cross-sectional side views of the operation of a ratchet shifter of the pole ratchet mechanism of FIG. 2.

The ratchet shifter 302 may be configured to be slidably attached to the pole 202. For example, the ratchet shifter 302 may extend at least partially into the pole 202 perpendicularly to the axis of the pole 202. In some embodiments, the ratchet shifter 302 may extend all the way through the pole 202 through openings 330 on either side of the pole 202 (only one of the openings 330 is shown in FIG. 2). The ratchet shifter 302 may include a head 332. A shifter magnet 303 may be positioned within the ratchet shifter 302, for example opposite the head 332. The ratchet sleeve 310 may be configured to be attached to the pole 202 (both laterally and rotationally) and may define a first set of radial teeth 334. The ratchet slider 312 may be configured to be slidably positioned in a receiving slot 213 of the pole support side arm 212 and may define a second set of radial teeth 336 designed and configured to selectively engage with the first set of radial teeth 334 of the ratchet sleeve 310. The receiving slot 213 may have a shape that generally matches the shape of the portion of the ratchet slider 312 that is configured to be positioned in the receiving slot 213 (such as the generally rectangular shapes disclosed in FIG. 2). In some embodiments, the pole support side arm 212 may include a pole cradle 215 attached thereto (for example, using the bolts disclosed in FIG. 2). The pole cradle 215 may be configured to support the weight of the pole 202 so that the weight of the pole 202 does not rest on the ratchet slider 312 when the ratchet slider 312 is positioned in the receiving slot 213. The ratchet shifter 302 may be configured to be manually shifted between an engaged position (as shown in FIGS. 3A and 3F) and a disengaged position (as shown in FIGS. 3C and 3D). The engaged position (as shown in FIGS. 3A and 3F) may include the first set of radial teeth 334 engaging with the second set of radial teeth 336 to allow the pole 202 to be manually rotated only in a first rotational direction (e.g., counter-clockwise) and prevented from rotating in a second rotational direction that is opposite the first rotational direction (e.g., clockwise). The disengaged position (as shown in FIGS. 3C and 3D) may include the first set of radial teeth 334 disengaged or separated from the second set of radial teeth 336 to allow the pole 202 to be manually rotated freely both in the first rotational direction (e.g., clockwise) and in the second rotational direction (e.g., counter-clockwise) that is opposite from the first rotational direction.

The ratchet core shaft 304 may be configured to engage slidably with the ratchet shifter 302 within the pole 202, and also extend through any ratchet core housing of the ratchet core 306, the engagement spring 308, the ratchet sleeve 310, the ratchet slider 312, the washer 314, the e-clip 316, the collar 318, the hand wheel 320, and the washer 324, before the nut 326 is threaded onto the ratchet core shaft 304. In this manner, the engagement spring 308, the ratchet sleeve 310, the ratchet slider 312, the washer 314, the e-clip 316, the collar 318, the hand wheel 320, and the washer 324 may be sandwiched between a collar 338 on the ratchet core 306 and the nut 326. While the ratchet shifter 302 and the ratchet sleeve 310 remain in a fixed lateral position with respect to the pole 202, all other components of the pole ratchet mechanism 300 may be configured to shift laterally with respect to the pole 202. This lateral shifting may be accomplished in one direction due to a bias provided by the engagement spring 308, and in the other direction due to the ratchet shifter 302 being pressed by a user and thus overcoming the bias provided by the engagement spring 308, as discussed in greater detail below. The engagement spring 308 may be positioned within the ratchet sleeve 310 and within the pole 202 and may bias against the collar 338 on the ratchet core 306 and against the ratchet sleeve 310 to bias the ratchet core shaft 304 into the pole 202.

The hand wheel 320 and/or the handle 322 and/or the pole 202 itself may be configured to be manually rotated in order to rotate the ratchet core shaft 304, the ratchet sleeve 310, and the pole 202, among other components.

FIG. 2 also illustrates an idler end cap 400 that is configured to be attached to the pole 202, opposite the pole ratchet mechanism 300, for example by means of a snap-in feature engaging with an opening defined in the end of the pole 202. The idler end cap 400 may include an idler end cap housing 402 configured to be attached to the pole 202 (both laterally and rotationally) with screws 404, and an idler end cap pulley 406 configured to be attached to the idler end cap housing 402 and configured to be positioned in the receiving slot 213 of the pole support side arm 212. The idler end cap 400 may be configured to allow the pole 202 to be rotated in the first and second rotational directions while maintaining the position of the pole 202 laterally or axially.

Figure 3B:
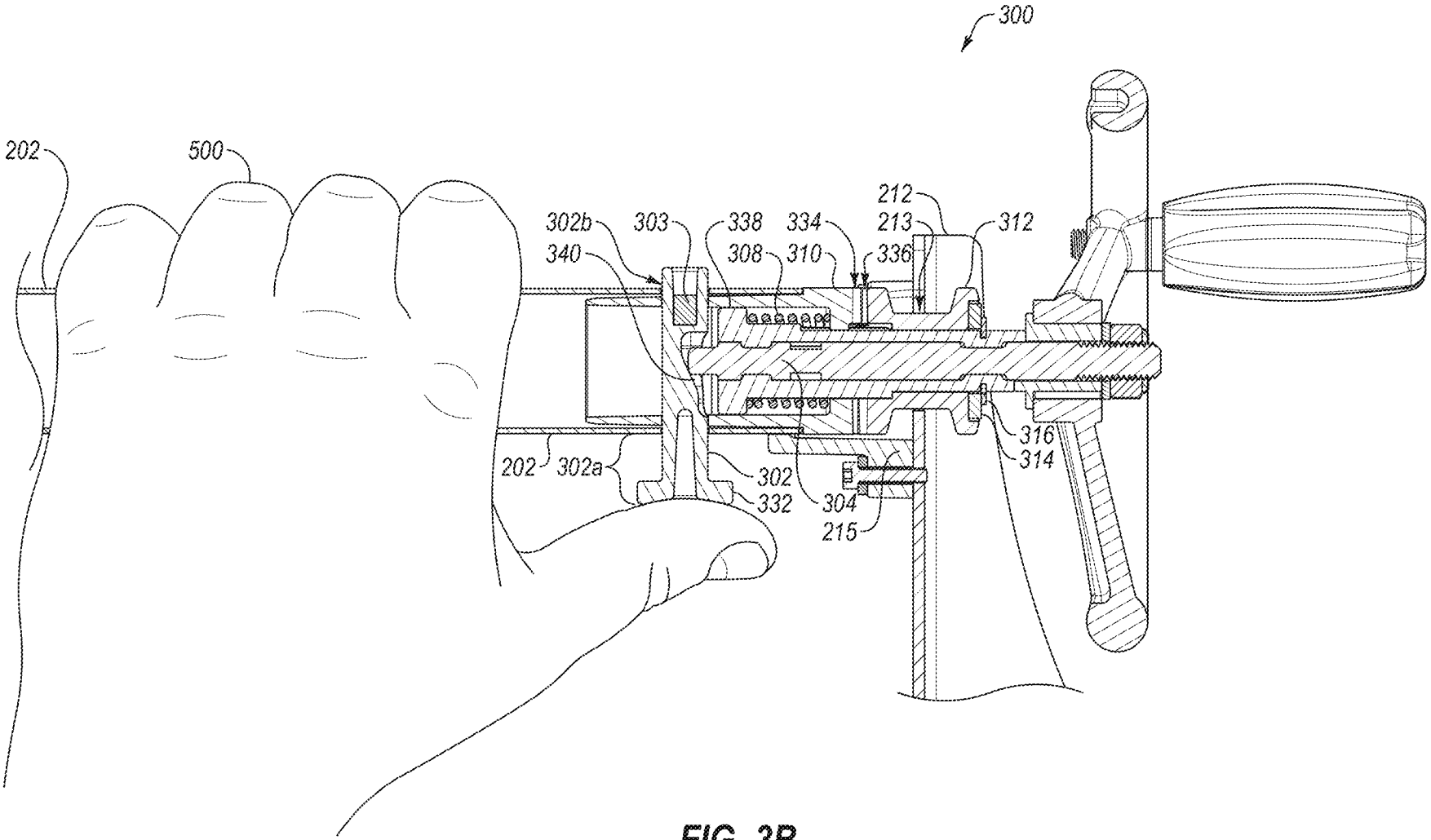
Figure 3C:
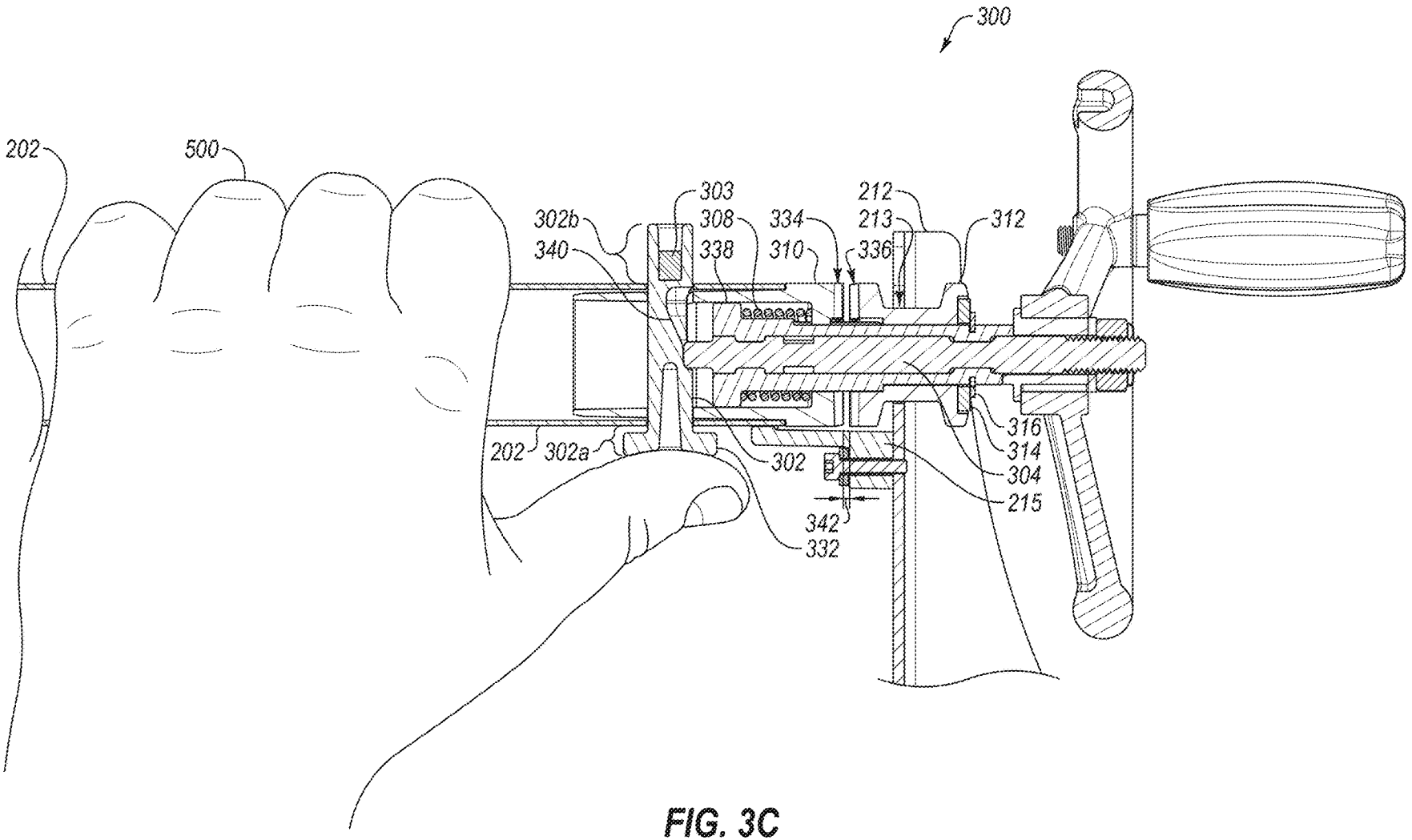
Figure 3D:
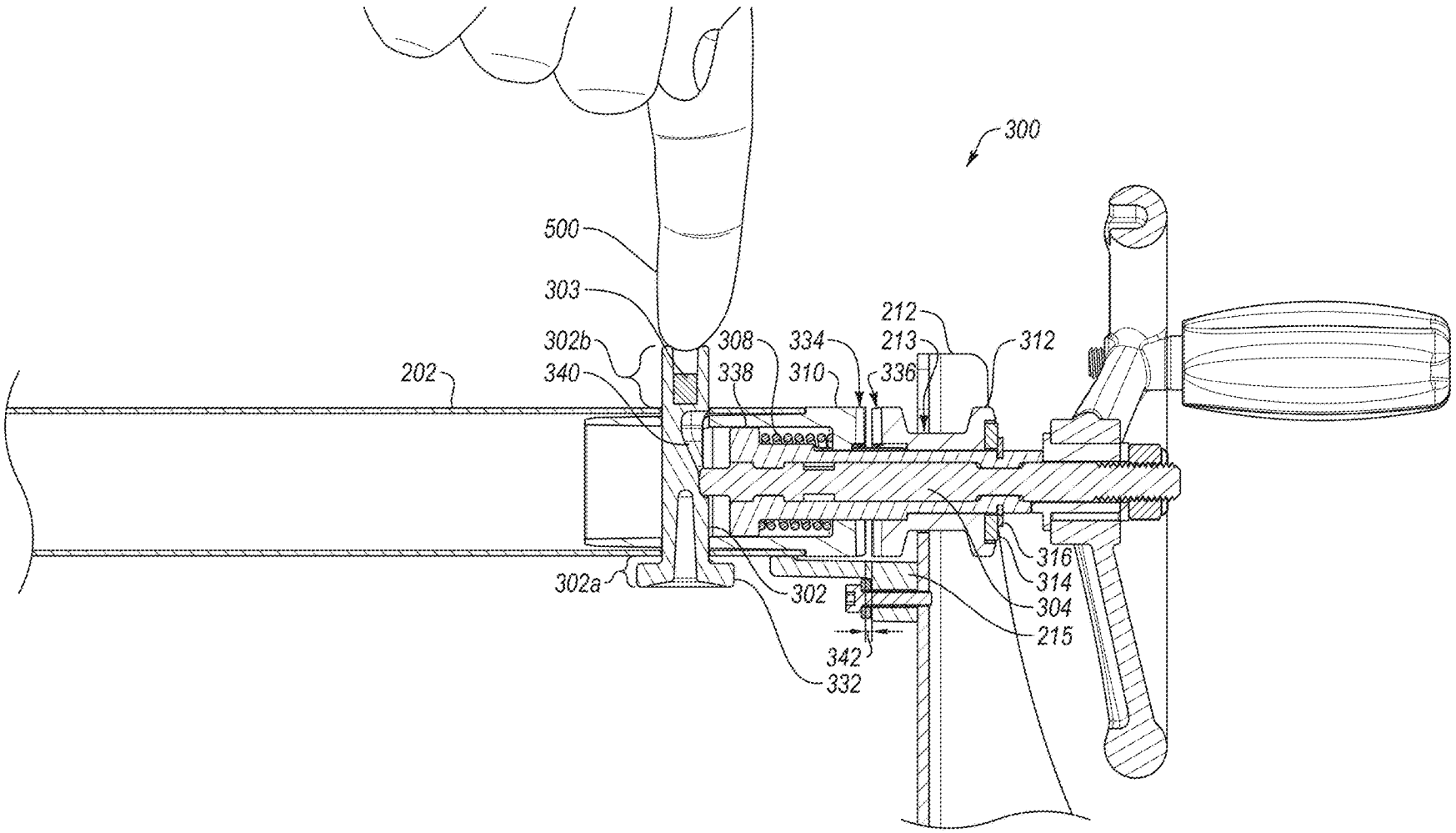
Figure 3E:
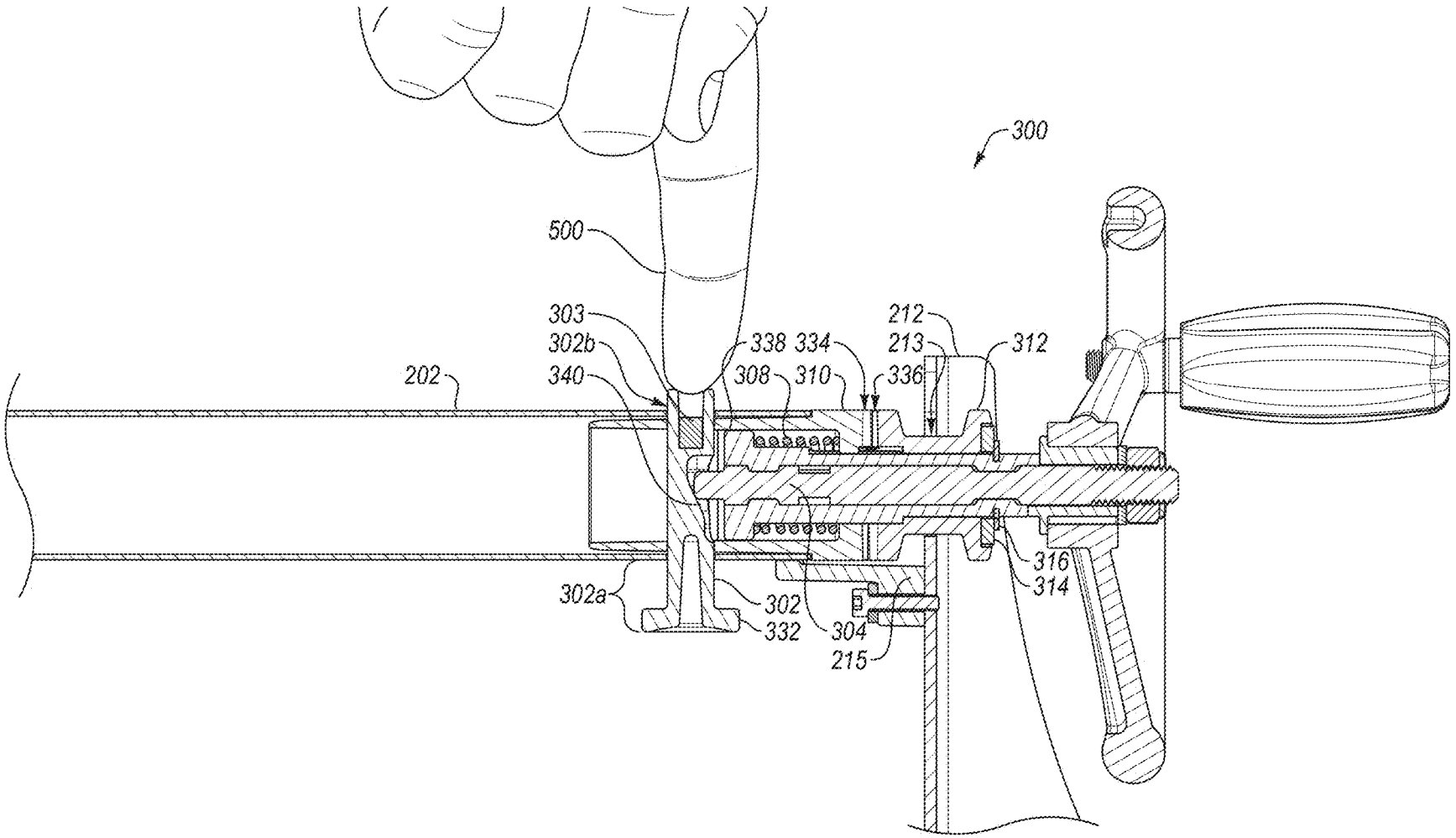
Figure 3F:
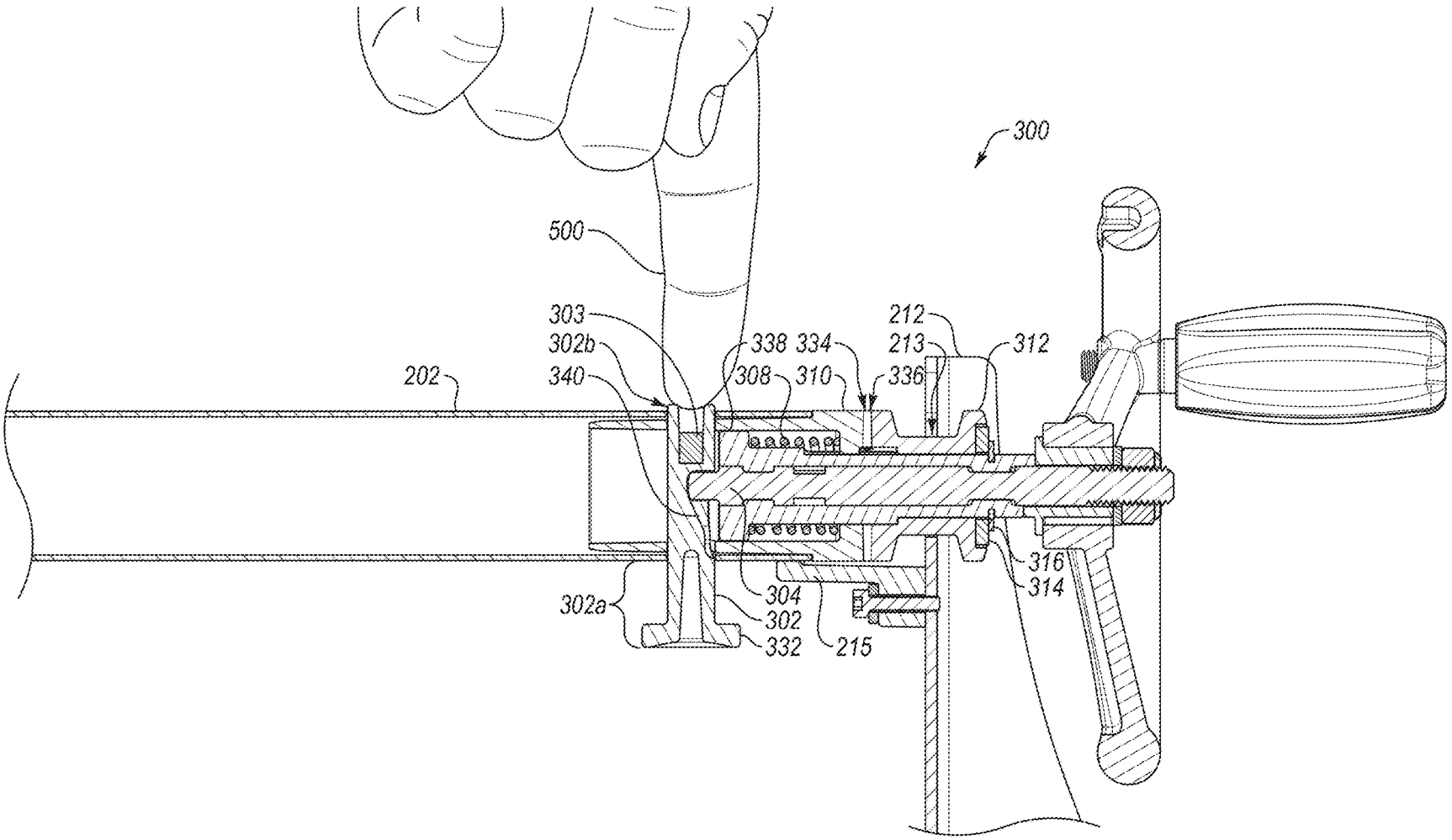
Figure 4A:
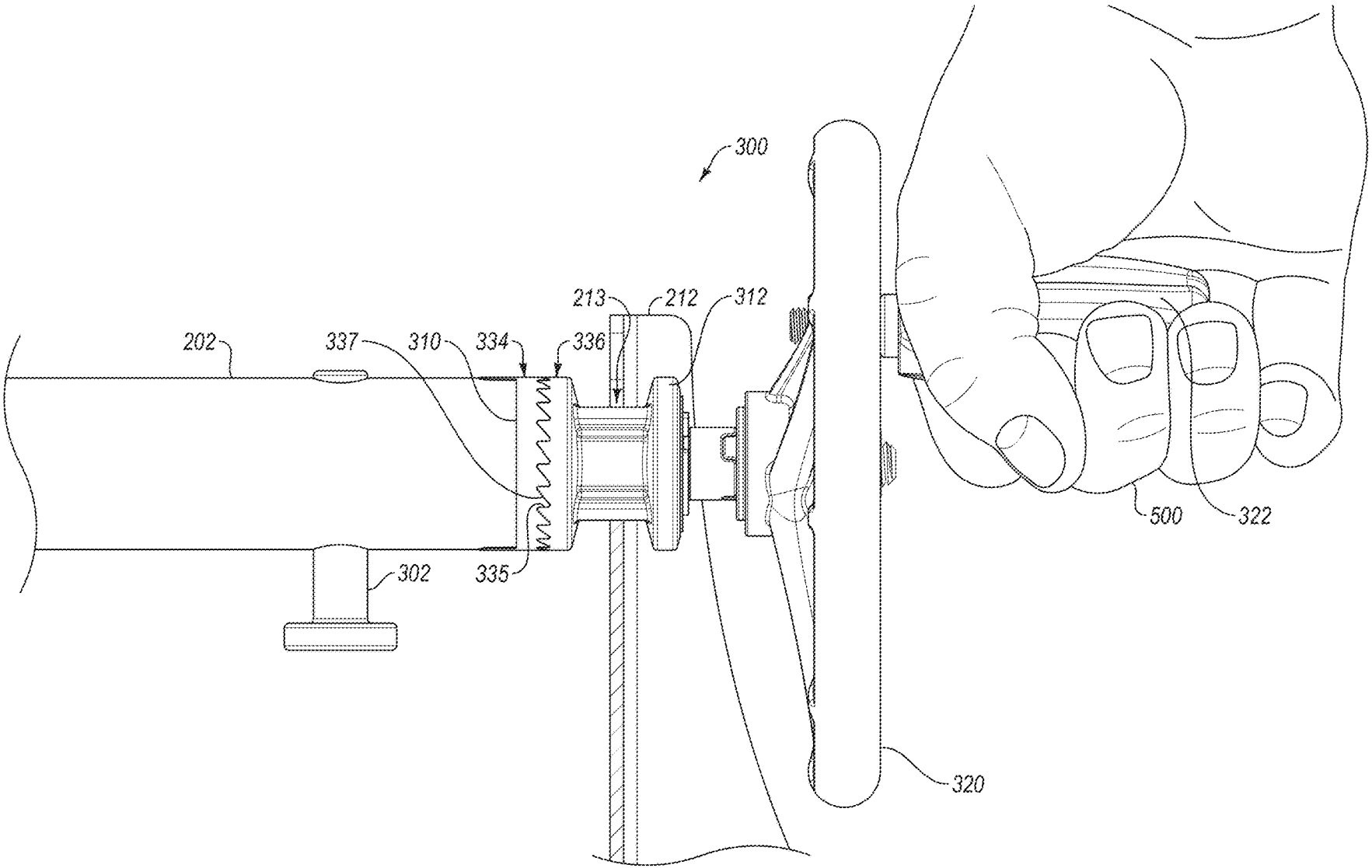
FIGS. 4A-4D are partial-cross-sectional side views of the one-way rotation, when engaged, of the pole ratchet mechanism of FIG. 2.
Figure 4B:
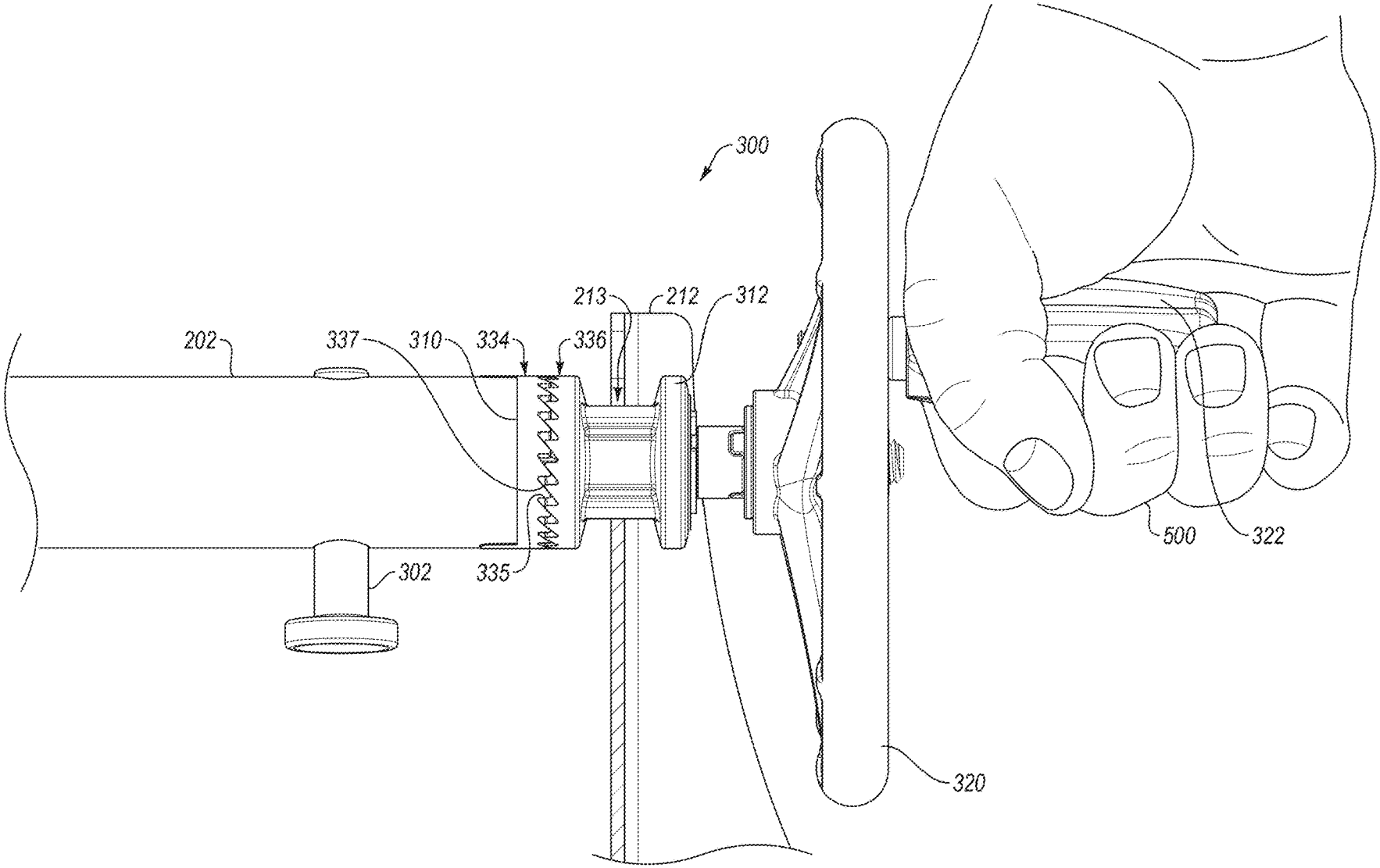
Figure 4C:
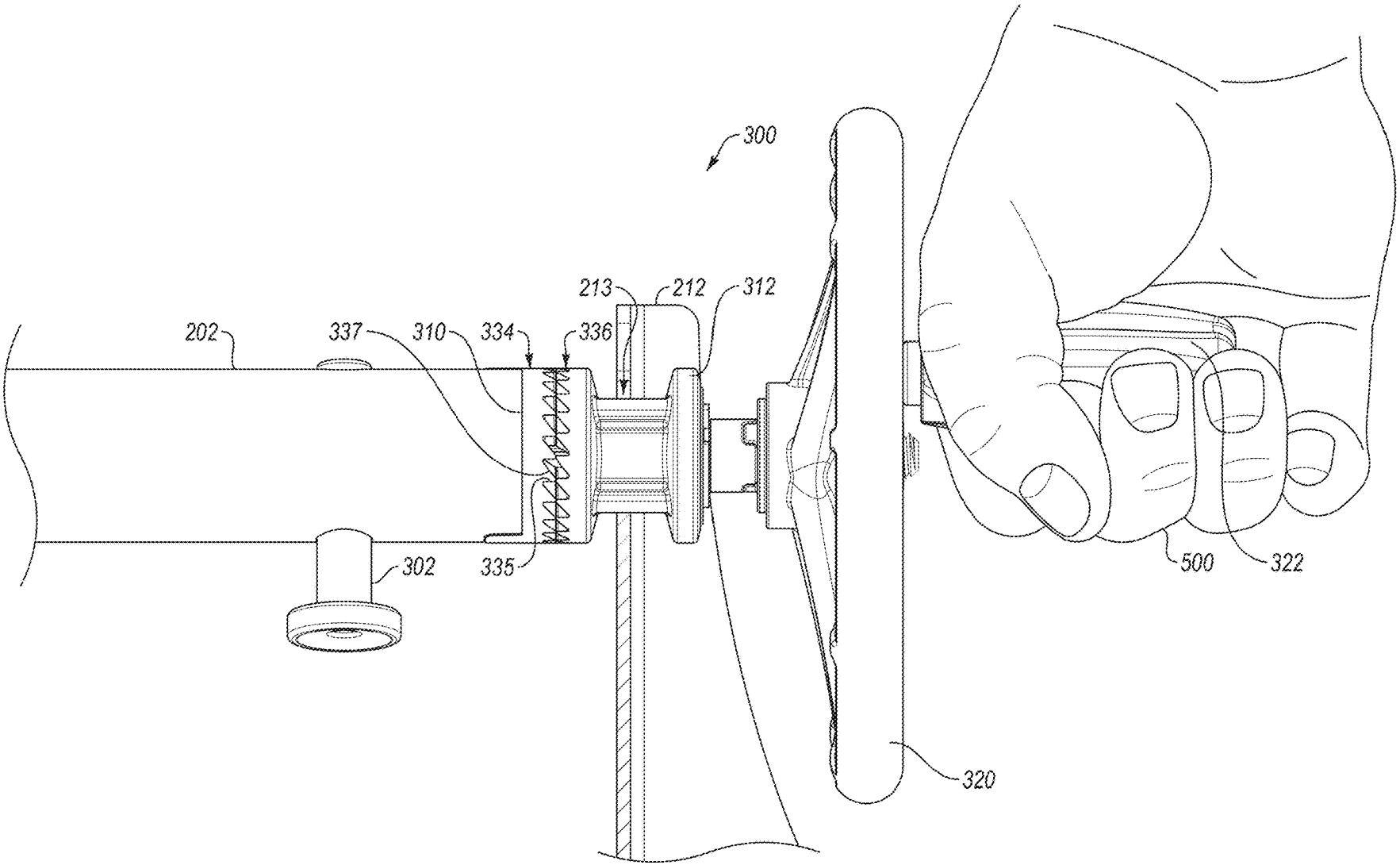
Figure 4D:
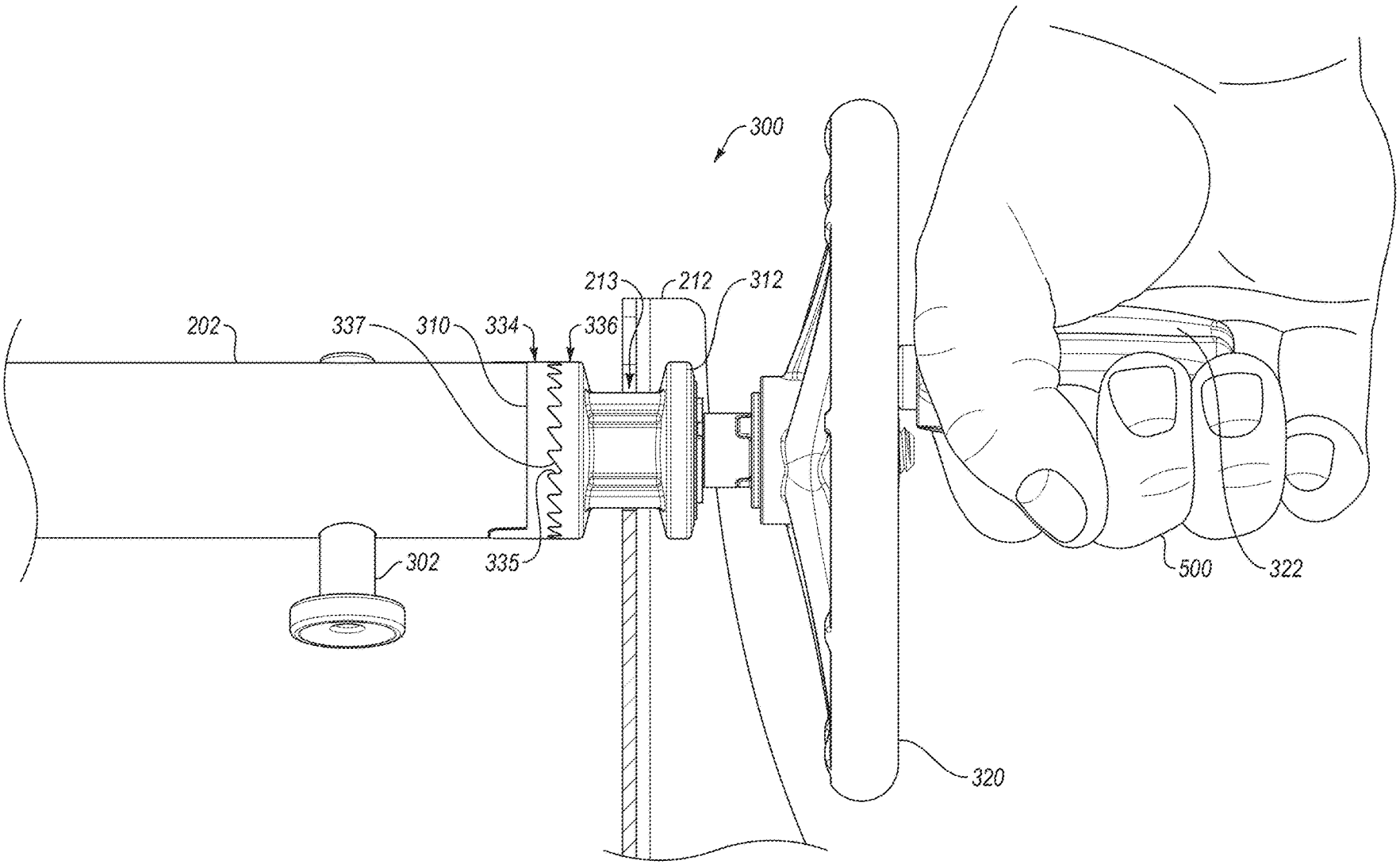

FIGS. 3A-3F are partial-cross-sectional side views of the operation of the ratchet shifter 302 of the pole ratchet mechanism 300 of FIG. 2. In particular, the progression from FIG. 3A to FIG. 3C illustrates the ratchet shifter 302 being manually shifted by a user 500 from the engaged position (as shown in FIG. 3A) to the disengaged position (as shown in FIG. 3C), while the progression from FIG. 3D to FIG. 3F illustrates the ratchet shifter 302 being manually shifted by a user 500 from the engaged position (as shown in FIG. 3D) to the disengaged position (as shown in FIG. 3F).

As disclosed in FIGS. 3A-3F, the ratchet shifter 302 may include a first portion 302*a* extending from the pole 202 that may be visually different from a second portion 302*b* extending from the pole 202 opposite the first portion 302*a*, such as by being larger in diameter. In these embodiments, the first portion 302*a* of the ratchet shifter may include the head 332 that is visually different from the second portion 302*b* of the ratchet shifter 302, such as having a diameter that is larger than the remainder of the ratchet shifter 302. This visual difference may enable a user to distinguish between pressing on the first portion 302*a* of the ratchet shifter 302 to disengage the pole ratchet mechanism 300 (as disclosed in the progression from FIG. 3A to FIG. 3C) and pressing on the second portion 302*b* of the ratchet shifter 302 to engage the pole ratchet mechanism 300 (as disclosed in the progression from FIG. 3D to FIG. 3F). Between the first portion 302*a* and the second portion 302*b* of the ratchet shifter 302, a ramped surface 340 may be defined.

As disclosed in FIGS. 3A-3F, the ratchet slider 312 may be positioned in the receiving slot 213 of the pole support side arm 212 to prevent the ratchet slider 312 from rotating while positioned in the receiving slot 213 (e.g., due to matching shapes of the receiving slot 213 and the portion of the ratchet slider 312 positioned in the receiving slot 213—which in this embodiment is a rectangular shape) but configured to allow the ratchet slider 312 to slide laterally while positioned in the receiving slot 213. In some embodiments, the pole support side arm 212 may include the pole cradle 215 attached thereto. The pole cradle 215 may be configured to support the weight of the pole 202 so that the weight of the pole 202 does not rest on the ratchet slider 312 when the ratchet slider 312 is positioned in the receiving slot 213. The ratchet core shaft 304 may be slidably attached to the ratchet sleeve 310 (via a ratchet core housing of the ratchet core 306 for example) to allow the ratchet core shaft 304 to slide laterally with respect to the ratchet sleeve 310 but to prevent the ratchet core shaft 304 from rotating without the ratchet sleeve 310, and the pole 202, also rotating. In contrast, the ratchet core shaft 304 may be rotatably attached to the ratchet slider 312 (via the washer 314, the e-clip 316, and a ratchet core housing of the ratchet core 306 for example) to allow the ratchet core shaft 304 to rotate with respect to the ratchet slider 312 but to prevent the ratchet core shaft 304 from sliding laterally without the ratchet sleeve 310 also sliding laterally.

As disclosed in FIGS. 3A-3F, the engagement spring 308 may be positioned within the ratchet sleeve 310 and within the pole 202 and may bias against the collar 338 on the ratchet core 306 and against the ratchet sleeve 310 to bias the ratchet core shaft 304 into the pole 202. The ratchet shifter 302 may also include a ramped surface 340 configured to engage with the ratchet core shaft 304 to force the ratchet core shaft 304 to shift laterally out of the pole 202 in order to disengage the pole ratchet mechanism 300.

As disclosed in FIG. 3A, while the pole ratchet mechanism 300 is in the engaged position, the engagement spring 308 may bias the first set of radial teeth 334 of the ratchet sleeve 310 to engage with the second set of radial teeth 336 of the ratchet slider 312. While thus engaged, the first set of radial teeth 334 and the second set of radial teeth 336 may only allow the pole 202 to be manually rotated in the first rotational direction.

In some embodiments, the shifter magnet 303 may be positioned within the ratchet shifter 302, and may be configured to produce a magnetic field that tends to hold the ratchet shifter 302 in the engaged position disclosed in FIG. 3A. The shifter magnet 303 may be particularly helpful when the pole 202 is rotated. For example, when the pole 202 is rotated such that the head 332 of the ratchet shifter 302 is rotated between the 10 o'clock position and the 2' o'clock position, the shifter magnet 303 may overcome and prevent gravity that is pulling down on the ratchet shifter 302 from causing the ratchet shifter 302 to fall downward. Thus, the shifter magnet 303 may prevent the ratchet shifter 302 from inadvertently falling downward and consequently prevent the pole ratchet mechanism 300 from inadvertently moving out of the engaged position.

As disclosed in the progression from FIG. 3A to FIG. 3C, when the user 500 presses against the first portion 302*a* of the ratchet shifter 302, with the user's thumb for example, this pushing may cause the ratchet core shaft 304 to slide up the ramped surface 340, thus causing the ratchet core shaft 304 to overcome the bias of the engagement spring 308 to force the first set of radial teeth 334 to disengage or separate from the second set of radial teeth 336, resulting in a gap 342 (as disclosed in FIGS. 3C and 3D) between the first set of radial teeth 334 and the second set of radial teeth 336. While thus disengaged, the first set of radial teeth 334 and the second set of radial teeth 336 may allow the pole 202 to be manually rotated both in the first rotational direction and in the second rotational direction.

As disclosed in the progression from FIG. 3D to FIG. 3F, when the user 500 presses against the second portion 302*b* of the ratchet shifter 302, with the user's finger for example, this pushing may allow the bias of the engagement spring 308 to cause the ratchet core shaft 304 to slide down the ramped surface 340, thus allowing the engagement spring 308 to once again bias the first set of radial teeth 334 of the ratchet sleeve 310 to engage with the second set of radial teeth 336 of the ratchet slider 312, resulting in elimination of the gap 342 (as disclosed in FIGS. 3C and 3D) between the first set of radial teeth 334 and the second set of radial teeth 336. While once again thus engaged, the first set of radial teeth 334 and the second set of radial teeth 336 may only allow the pole 202 to be manually rotated in the first rotational direction.

FIGS. 4A-4D are partial-cross-sectional side views of the one-way rotation, when engaged, of pole ratchet mechanism 300 of FIG. 2. Although the pole cradle 215 is not illustrated in FIGS. 4A-4D to avoid obscuring the radial teeth of the pole ratchet mechanism 300, it is understood that the pole cradle 215 may be included in the embodiment disclosed in FIGS. 4A-4D. The progression from FIG. 4A to FIG. 4D illustrates the pole ratchet mechanism 300 with the ratchet shifter 302 in the engaged position. As noted above, while the pole ratchet mechanism 300 is in the engaged position, the first set of radial teeth 334 of the ratchet sleeve 310 may be biased to engage with the second set of radial teeth 336 of the ratchet slider 312. While thus engaged, the first set of radial teeth 334 and the second set of radial teeth 336 may only allow the pole 202 to be manually rotated in the first rotational direction, which is referred to herein as a one-way rotation.

This one-way rotation of the pole 202 while the pole ratchet mechanism 300 is in the engaged position may be accomplished, in some embodiments, by the shape of the radial teeth of the ratchet sleeve 310 and the ratchet slider 312. For example, in some embodiments, each tooth of the first set of radial teeth 334 and the second set of radial teeth 336 may have a vertical edge 335 and a sloped edge 337, such that engagement of the first set of radial teeth 334 and the second set of radial teeth 336 allows the sloped edges 337 to slide past each other in the first rotational direction but prevents the vertical edges 335 from sliding past each other in the second rotational direction.

As disclosed in the progression from FIG. 4A to FIG. 4D, when the user 500 rotates the pole 202 via the handle 322, or by rotating the pole 202 directly, in the first rotational direction (which is clockwise from the perspective of the user 500 in this example), the sloped edges 337 of the engaged first set of radial teeth 334 and second set of radial teeth 336 may allow the first set of radial teeth 334 and the second set of radial teeth 336 to slide past each other, such that the ratchet sleeve 310 and the pole 202 can rotate while the ratchet slider 312 is prevented from rotating due to its engagement with the receiving slot 213 defined in the pole support side arm 212. At the same time, if the user 500 were to try to rotate the pole 202 in a second rotational direction (which is counter-clockwise from the perspective of the user 500 in this example), the vertical edges 335 of the engaged first set of radial teeth 334 and second set of radial teeth 336 may prevent the first set of radial teeth 334 and the second set of radial teeth 336 from sliding past each other in the second rotational direction, such that the ratchet sleeve 310 and the pole 202 cannot rotate due to the ratchet slider 312 being prevented from rotating due to its engagement within the receiving slot 213 defined in the pole support side arm 212. Therefore, in this example, the engagement of the pole ratchet mechanism 300 only allows a one-way rotation of the pole 202 in the first rotational direction (clockwise from the perspective of the user 500) but prevents rotation of the pole in the second rotational direction (counter-clockwise from the perspective of the user 500).

In the context of the fabric suspension frame 200 of FIG. 1B, this one-way rotation in the pole 202 may allow the user 500 to set and maintain a desired amount of tension to the quilt-backing fabric 256 and the quilt-top fabric 258 (and the quilt-batting fabric 260 sandwiched there between) being quilted together by the maneuverable quilting machine 100 (or other sewing machine configured for quilting). Further, the integration of the pole ratchet mechanism 300 into the pole 202, instead of including portions that are separate from the pole 202, may result in the pole ratchet mechanism 300 being easier and more ergonomic to use while being simpler and less costly than current pole tensioning mechanisms, and may also include less risk for a user's fingers to be pinched than current pole tensioning mechanisms.

Modifications, additions, or omissions may be made to the pole ratchet mechanism 300 without departing from the scope of the present disclosure. For example, in some embodiments, the engagement spring 308 may be replaced with other means for biasing the ratchet core shaft 304 against the ramped surface 340 of the ratchet shifter 302. Also, in some embodiments, the engagement of the first set of radial teeth 334 and the second set of radial teeth 336 may be replaced with a single set of radial teeth and one or more pawls that engage the single set of radial teeth. Further, in some embodiments, the ramped surface 340 of the ratchet shifter 302 may be modified to run around the diameter of the ratchet shifter 302 instead of axially along a length of the ratchet shifter 302, which modification would allow the ratchet shifter 302 to be rotated (instead of slid) to shift between the engaged position (shown in FIGS. 3A and 3F) and the disengaged position (shown in FIGS. 3C and 3D).

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A fabric suspension frame comprising:
a pole support side arm defining a receiving slot;
a pole configured to have fabric spooled thereon and configured to be manually rotated in a first rotational direction and a second rotational direction that is opposite from the first rotational direction; and
a pole ratchet mechanism including:
a ratchet sleeve attached to the pole, the ratchet sleeve defining a first set of teeth;
a ratchet slider configured to be positioned in the receiving slot of the pole support side arm, the ratchet slider defining a second set of teeth configured to selectively engage with the first set of teeth; and
a ratchet shifter attached to the pole, the ratchet shifter configured to be manually shifted between an engaged position and a disengaged position, the engaged position including the first set of teeth engaging with the second set of teeth to allow the pole to be manually rotated only in the first rotational direction, the disengaged position including the first set of teeth disengaged from the second set of teeth to allow the pole to be manually rotated both in the first rotational direction and in the second rotational direction.

2. The fabric suspension frame of claim 1, wherein each tooth of the first set of teeth and the second set of teeth has a vertical edge and a sloped edge such that engagement of the first set of teeth and the second set of teeth allows the sloped edges to slide past each other in the first rotational direction but prevents the vertical edges from sliding past each other in the second rotational direction.

3. The fabric suspension frame of claim 1, wherein the ratchet shifter extends at least partially into the pole.

4. The fabric suspension frame of claim 1, wherein:
the ratchet shifter extends all the way through the pole; and
the ratchet shifter includes a shifter magnet positioned within the ratchet shifter.

5. The fabric suspension frame of claim 4, wherein the ratchet shifter is configured to be manually shifted between the engaged position and the disengaged position by sliding the ratchet shifter at least partially through the pole.

6. The fabric suspension frame of claim 4, wherein a first portion of the ratchet shifter extending from the pole is visually different from a second portion of the ratchet shifter extending from the pole opposite the first portion.

7. The fabric suspension frame of claim 6, wherein the first portion of the ratchet shifter includes a head that is visually different from the second portion of the ratchet shifter.

8. A fabric suspension frame comprising:
a pole support side arm defining a receiving slot;
a pole configured to have fabric spooled thereon and configured to be manually rotated in a first rotational direction and a second rotational direction that is opposite from the first rotational direction; and
a pole ratchet mechanism including:
a ratchet sleeve attached to the pole, the ratchet sleeve defining a first set of teeth;
a ratchet slider configured to be positioned in the receiving slot of the pole support side arm, the ratchet slider defining a second set of teeth configured to selectively engage with the first set of teeth;

an engagement spring; and a ratchet shifter attached to the pole, the ratchet shifter configured to be manually shifted between an engaged position and a disengaged position, the engaged position allowing the engagement spring to bias the first set of teeth to engage with the second set of teeth to allow the pole to be manually rotated only in the first rotational direction, the disengaged position overcoming the bias of the engagement spring to force the first set of teeth to disengage from the second set of teeth to allow the pole to be manually rotated both in the first rotational direction and in the second rotational direction.

9. The fabric suspension frame of claim 8, wherein the engagement spring is positioned within the pole.

10. The fabric suspension frame of claim 9, wherein the engagement spring is positioned within the ratchet sleeve.

11. The fabric suspension frame of claim 8, wherein each tooth of the first set of teeth and the second set of teeth has a vertical edge and a sloped edge such that engagement of the first set of teeth and the second set of teeth allows the sloped edges to slide past each other in the first rotational direction but prevents the vertical edges from sliding past each other in the second rotational direction.

12. The fabric suspension frame of claim 8, wherein the ratchet shifter extends all the way through the pole.

13. The fabric suspension frame of claim 12, wherein the ratchet shifter is configured to be manually shifted between the engaged position and the disengaged position by rotating the ratchet shifter.

14. The fabric suspension frame of claim 12, wherein a first portion of the ratchet shifter extending from the pole includes a head that is visually different from a second portion of the ratchet shifter extending from the pole opposite the first portion.

15. A fabric suspension frame comprising:

a pole configured to have fabric spooled thereon and configured to be manually rotated in a first rotational direction and a second rotational direction that is opposite from the first rotational direction;

a pole support side arm defining a receiving slot and including a pole cradle attached thereto that is configured to support the weight of the pole; and a pole ratchet mechanism including:

a ratchet sleeve attached to the pole, the ratchet sleeve defining a first set of teeth;

a ratchet slider configured to be positioned in the receiving slot of the pole support side arm to prevent the ratchet slider from rotating while positioned in the receiving slot but configured to allow the ratchet slider to slide laterally while positioned in the receiving slot, the ratchet slider defining a second set of teeth configured to selectively engage with the first set of teeth;

a ratchet core including a ratchet core shaft slidably attached to the ratchet sleeve to allow the ratchet core shaft to slide laterally with respect to the ratchet sleeve but to prevent the ratchet core shaft from rotating without the ratchet sleeve also rotating;

a handle attached to the ratchet core shaft and configured to be manually rotated in order to rotate the ratchet core shaft, the ratchet sleeve, and the pole;

an engagement spring surrounding the ratchet core shaft; and a ratchet shifter attached to the pole, the ratchet shifter configured to be manually shifted between an engaged position and a disengaged position, the engaged position allowing the engagement spring to bias the first set of teeth to engage with the second set of teeth to only allow the pole to be manually rotated in the first rotational direction, the disengaged position overcoming the bias of the engagement spring to force the first set of teeth to disengage from the second set of teeth to allow the pole to be manually rotated both in the first rotational direction and in the second rotational direction.

16. The fabric suspension frame of claim 15, wherein:

the engagement spring is positioned within the ratchet sleeve and within the pole; and the engagement spring biases the ratchet core shaft into the pole.

17. The fabric suspension frame of claim 15, wherein each tooth of the first set of teeth and the second set of teeth has a vertical edge and a sloped edge such that engagement of the first set of teeth and the second set of teeth allows the sloped edges to slide past each other in the first rotational direction but prevents the vertical edges from sliding past each other in the second rotational direction.

18. The fabric suspension frame of claim 15, wherein:

the ratchet shifter extends all the way through the pole;

the ratchet shifter is configured to be manually shifted between the engaged position and the disengaged position by sliding or rotating the ratchet shifter; and the ratchet shifter defines a ramped surface configured to force the ratchet core shaft to shift laterally in order to disengage the pole ratchet mechanism.

19. The fabric suspension frame of claim 15, wherein the pole ratchet mechanism further includes a hand wheel by which the handle is attached to the ratchet core shaft, the hand wheel configured to be manually rotated in order to rotate the ratchet core shaft, the ratchet sleeve, and the pole.

20. The fabric suspension frame of claim 15, further wherein:

the pole support side arm defines two additional receiving slots; and the fabric suspension frame further comprises two other poles and two other pole ratchet mechanisms.

* * * * *